US009776407B2

(12) United States Patent
Rivas et al.

(10) Patent No.: US 9,776,407 B2
(45) Date of Patent: Oct. 3, 2017

(54) FLUID EJECTION DEVICE WITH INK FEEDHOLE BRIDGE

(71) Applicant: HEWLETT-PACKARD DEVELOPMENT COMPANY, L.P., Houston, TX (US)

(72) Inventors: Rio Rivas, Corvallis, OR (US); Anthony M. Fuller, Corvallis, OR (US); Ed Friesen, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/785,706

(22) PCT Filed: Apr. 30, 2013

(86) PCT No.: PCT/US2013/038739
§ 371 (c)(1),
(2) Date: Oct. 20, 2015

(87) PCT Pub. No.: WO2014/178830
PCT Pub. Date: Nov. 6, 2014

(65) Prior Publication Data
US 2016/0101620 A1 Apr. 14, 2016

(51) Int. Cl.
*B41J 2/14* (2006.01)

(52) U.S. Cl.
CPC ..... *B41J 2/1433* (2013.01); *B41J 2/14145* (2013.01)

(58) Field of Classification Search
CPC ..... B41J 2/1433
See application file for complete search history.

(56) References Cited

U.S. PATENT DOCUMENTS

| | | | | |
|---|---|---|---|---|
| 4,789,425 | A * | 12/1988 | Drake | B23P 15/00 216/16 |
| 4,864,329 | A | 9/1989 | Kneezel et al. | |
| 6,158,846 | A | 12/2000 | Kawamura | |
| 6,543,879 | B1 | 4/2003 | Feinn et al. | |
| 6,555,480 | B2 | 4/2003 | Milligan et al. | |
| 6,776,915 | B2 | 8/2004 | Beatty et al. | |
| 6,918,657 | B2 | 7/2005 | Kawamura et al. | |
| 7,226,149 | B2 | 6/2007 | Stout et al. | |
| 7,448,731 | B2 | 11/2008 | Murata | |
| 7,699,441 | B2 | 4/2010 | Lebens | |
| 7,862,150 | B2 | 1/2011 | Lee et al. | |
| 8,349,199 | B2 | 1/2013 | Jeong et al. | |
| 2004/0008239 | A1* | 1/2004 | Kubota | B41J 2/1404 347/65 |
| 2006/0114294 | A1 | 6/2006 | Kim | |

(Continued)

FOREIGN PATENT DOCUMENTS

JP 2008105384 5/2008

*Primary Examiner* — Bradley Thies
(74) *Attorney, Agent, or Firm* — HP Inc.—Patent Department

(57) ABSTRACT

In an embodiment, a fluid ejection device includes a substrate with a fluid slot formed therein, a chamber layer formed on the substrate defining fluid chambers on both sides of the fluid slot, a thin-film layer between the substrate and chamber layer that defines an ink feedhole (IFH) between the fluid slot and the chamber layer, and a chamber layer extension that forms a bridge across the IFH between two chambers.

16 Claims, 7 Drawing Sheets

(56) References Cited

U.S. PATENT DOCUMENTS

| | | | | |
|---|---|---|---|---|
| 2007/0064060 | A1* | 3/2007 | Gu | B41J 2/1404 347/65 |
| 2007/0081035 | A1* | 4/2007 | Worsman | B41J 2/1404 347/56 |
| 2008/0100666 | A1* | 5/2008 | Kim | B41J 2/1404 347/47 |
| 2008/0231665 | A1* | 9/2008 | Lee | B41J 2/1404 347/63 |
| 2010/0171793 | A1* | 7/2010 | Jeong | B41J 2/1404 347/47 |

* cited by examiner

View A-A
from FIG. 2

View B-B
from FIG. 2

View C-C
from FIG. 5

View D-D
from FIG. 7

FLUID EJECTION DEVICE WITH INK FEEDHOLE BRIDGE

BACKGROUND

Fluid ejection devices in inkjet printers provide drop-on-demand ejection of fluid drops. Inkjet printers produce images by ejecting ink drops from ink-filled chambers through nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within the ink-filled chamber. In another example, a piezoelectric inkjet printhead uses a piezoelectric material actuator to generate pressure pulses that force ink drops out of a nozzle.

Printhead nozzles are formed in a top layer of the printhead variously referred to as the nozzle plate, nozzle layer, tophat layer, and so on. After a printhead is assembled, the nozzles are sealed to prevent ink from leaking out of the printhead during transportation and storage. One cost effective way of sealing the nozzles is to put nozzle tape over the surface of the nozzle plate. However, nozzle plates are often formed of a relatively soft material such as SU8, or other material such as a polyimide. Therefore the nozzle plate is delicate, and in some areas it can be susceptible to being damaged when the nozzle tape is removed.

BRIEF DESCRIPTION OF THE DRAWINGS

The present embodiments will now be described, by way of example, with reference to the accompanying drawings, in which.

DETAILED DESCRIPTION

Overview

Figure 1A:
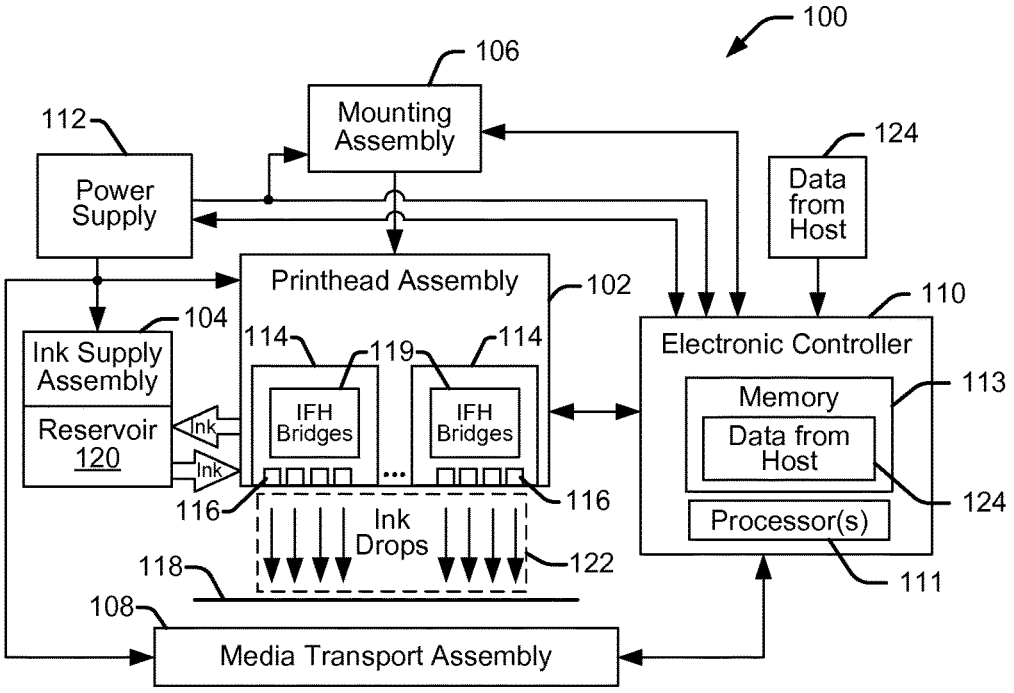
FIG. 1*a* illustrates a fluid ejection system implemented as an inkjet printing system, according to an example implementation.

As noted above, nozzle plates on inkjet printheads are typically formed of a soft material such as SU8, making them delicate and unable to safely seal with nozzle tape. More particularly, SU8 nozzle plates are not robust in the region of the ink feedhole (IFH), which is an area within the printhead that supplies ink to rows of chambers and nozzles on either side of the IFH. Ink passes through the IFH from the substrate ink slot into the chamber layer formed over the substrate. Thus, the IFH is defined by the gap in the substrate from the ink slot. The nozzle plate is formed over the chamber layer, and while chamber layer walls (e.g., ink chamber walls, ink path walls) on either side of the IFH provide support and bonding between the substrate and the nozzle plate, such support and bonding are not present within the IFH region. Therefore, because the removal of nozzle tape from the nozzle plate after shipping or storage tends to pull against the nozzle plate, it can result in tear outs of the nozzle plate SU8 material (or other nozzle plate material) along the IFH region. Tear outs of the SU8 nozzle plate material can cause serious defects that render the printhead ineffective.

Previous approaches for dealing with nozzle plate tear outs in the IFH region of printheads include the use of shipping caps instead of nozzle tape. However, shipping caps increase costs and can create problems associated with nozzle sealing and ink mixing within the caps. Accordingly, efforts to reduce the frequency of tear outs in the IFH region of nozzle plates formed of SU8 and other similar materials are ongoing.

Embodiments of the present disclosure improve on prior efforts to prevent nozzle plate tear outs, generally by providing bridges across the ink feedhole (IFH). The bridges comprise extensions of the chamber layer that span the gap across the IFH. The bridges support the nozzle plate and provide a bond or coupling between the printhead substrate and the area of the nozzle plate that extends over the IFH region. The bridges can have various design shapes and can be formed across the IFH gap between every chamber, or between any number of chambers. The numbers and shapes of the bridges can be tailored to support printhead functionality in terms of fluid flow into the ink chambers and structural support of the printhead.

In one example, a fluid ejection device includes a substrate with a fluid slot formed therein. A chamber layer is formed on the substrate and defines fluid chambers on both sides of the fluid slot. A thin-film layer between the substrate and chamber layer defines an ink feedhole (IFH) between the fluid slot and the chamber layer, and a chamber layer extension forms a bridge across the IFH between two chambers.

In another example, a fluid ejection device includes a thin-film layer formed on a substrate. The fluid ejection device includes a primer layer on the thin-film layer, and a chamber layer on the primer layer that defines chambers. A slot extends through the substrate and into the chamber layer through an ink feedhole (IFH) in the thin-film layer. The fluid ejection device includes an IFH bridge comprising a chamber layer extension across the IFH between corresponding chambers on opposite sides of the IFH.

In another example, a fluid ejection device includes a substrate with a fluid slot. A chamber layer is formed on the substrate and defines fluid chambers on both sides of the fluid slot. A thin-film layer is between the substrate and chamber layer that defines an ink feedhole (IFH) between the fluid slot and the chamber layer. A thin-film layer extension extends across the IFH, and a discontinuous chamber layer segment is formed on the thin-film layer extension. The thin-film layer extension and discontinuous chamber layer segment form an IFH bridge.

Illustrative Embodiments

FIG. 1*a* illustrates a fluid ejection system implemented as an inkjet printing system 100, according to an example implementation. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this example, fluid ejection devices 114 are implemented as fluid drop jetting printheads 114 (i.e., inkjet printheads 114). Inkjet printhead assembly 102 includes at least one fluid drop jetting printhead 114 that ejects drops of ink through a plurality of orifices or nozzles 116 toward print media 118 so as to print onto the print media 118. Nozzles 116 formed in a nozzle plate, or nozzle layer, are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, each printhead 114 comprises ink feedhole bridges 119 that extend across an ink feedhole and provide support and substrate bonding to the nozzle plate, which helps prevent nozzle tear outs during the removal of nozzle tape.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

Figure 1B:
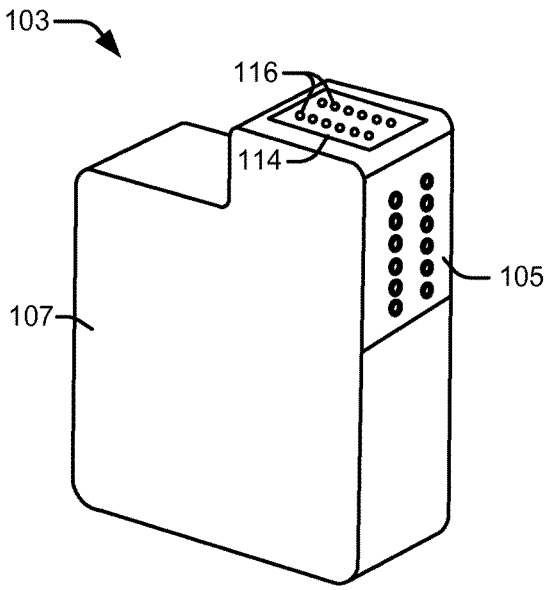
FIG. 1*b* shows a perspective view of an example inkjet cartridge that includes an inkjet printhead assembly and ink supply assembly, according to an example implementation.

In some implementations, inkjet printhead assembly 102 and ink supply assembly 104 (including reservoir 120) are housed together in a replaceable device such as an integrated inkjet printhead cartridge or pen 103, as shown in FIG. 1*b*. FIG. 1*b* shows a perspective view of an example inkjet cartridge 103 that includes inkjet printhead assembly 102 and ink supply assembly 104. In addition to printhead 114, inkjet cartridge 103 includes electrical contacts 105 and an ink (or other fluid) supply chamber 107. In some implementations cartridge 103 may have a single supply chamber 107 that stores one color of ink, and in other implementations it may have a number of chambers 107 that each store a different color of ink. Electrical contacts 105 carry electrical signals to and from controller 110, for example, to cause the ejection of ink drops through nozzles 116.

In some implementations, inkjet printhead assembly 102 comprises an inkjet printbar having multiple printheads 114 arranged in staggered rows. The ink supply assembly 104 can be separate from inkjet printhead assembly 102 and supply ink to inkjet printhead assembly 102 through an interface connection, such as a supply tube. In either implementation, reservoir 120 of ink supply assembly 104 may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly that includes one printhead 114. As such, mounting assembly 106 includes a carriage for moving inkjet printhead assembly 102 relative to media transport assembly 108 to scan print media 118. In another implementation, inkjet printhead assembly 102 is a non-scanning type printhead assembly with multiple printheads 114, such as a page wide array (PWA) print bar, or carrier. A PWA printbar carries the printheads 114, provides electrical communication between the printheads 114 and electronic controller 110, and provides fluidic communication between the printheads 114 and the ink supply assembly 104. Thus, mounting assembly 106 fixes inkjet printhead assembly 102 at a prescribed position while media transport assembly 108 positions and moves print media 118 relative to inkjet printhead assembly 102.

In one implementation, inkjet printing system 100 is a drop-on-demand thermal bubble inkjet printing system comprising thermal inkjet (TIJ) printhead(s). The TIJ printhead implements a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters.

Figure 2:
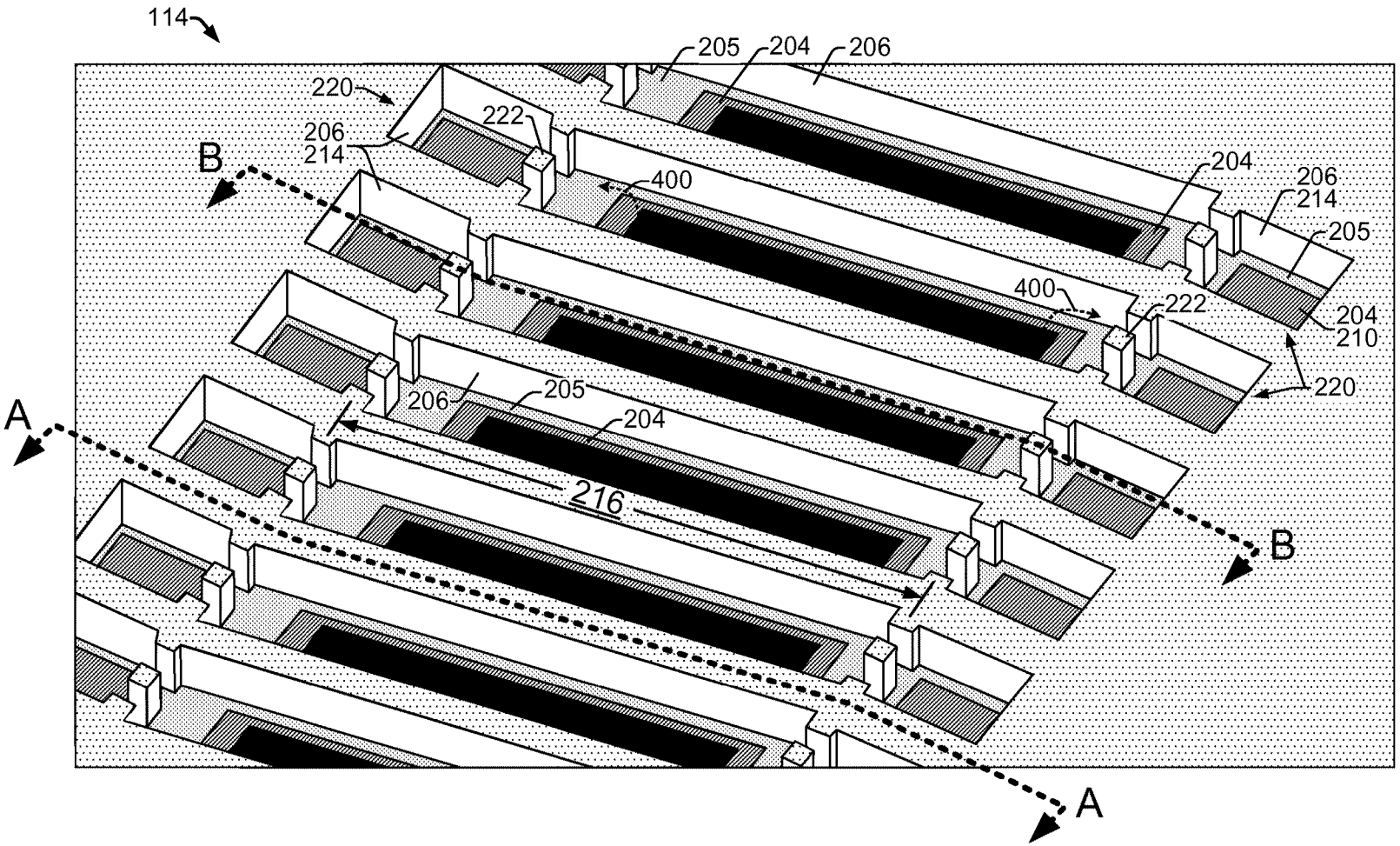
FIG. 2 shows a perspective view of a portion of a printhead, according to an example implementation.
Figure 3:
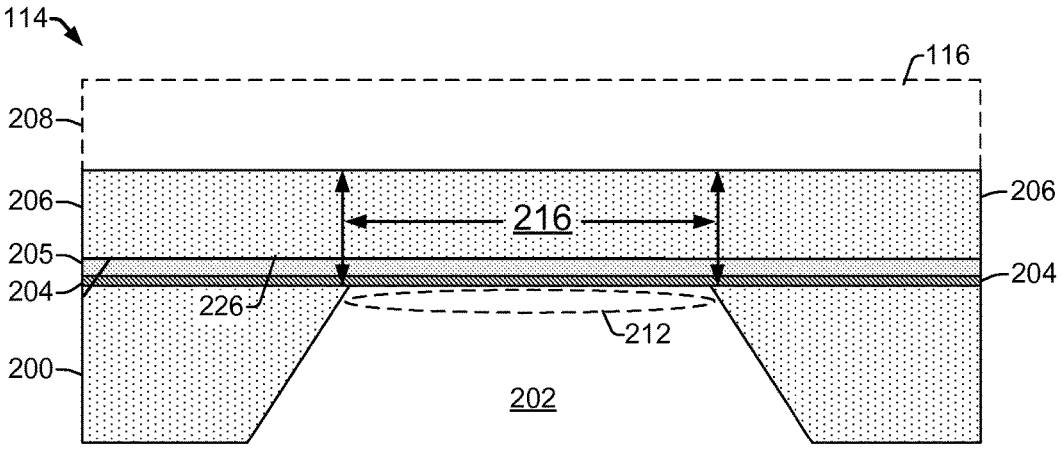
FIG. 3 shows a cross-sectional side view taken from the printhead shown in FIG. 2, according to an example implementation.
Figure 4:
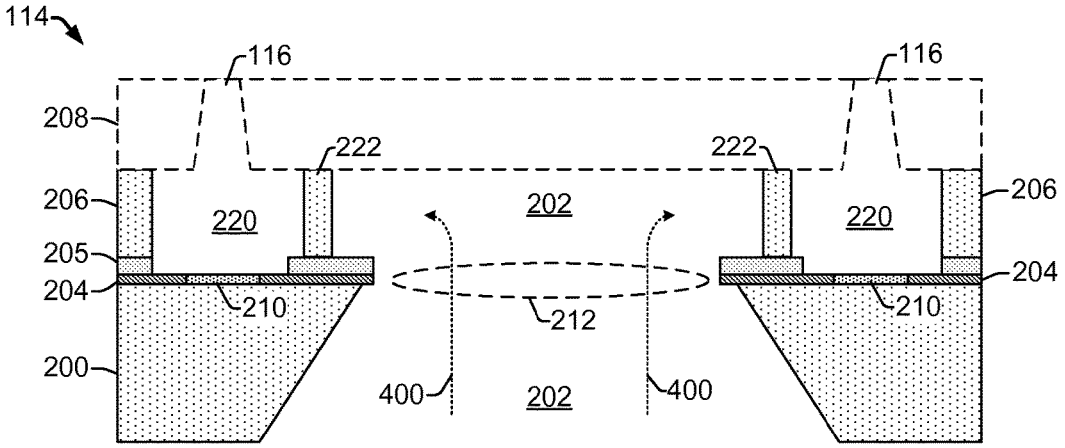
FIG. 4 shows a cross-sectional side view taken from the printhead shown in FIG. 2, according to an example implementation.

FIG. 2 shows a perspective view of a portion of a fluid ejection device 114 (i.e., printhead 114), according to an example implementation. FIG. 3 shows a cross-sectional side view (view A-A) taken from the printhead 114 shown in FIG. 2, and FIG. 4 shows a cross-sectional side view (view B-B) taken from the printhead 114 shown in FIG. 2. The portion of printhead 114 shown in FIGS. 2-4 illustrate architectural features from each of several different layers of the printhead 114. A nozzle layer is shown using dashed lines in FIGS. 3 and 4. However, the nozzle layer is excluded from FIG. 2 in order to better illustrate other underlying features of the printhead 114. The different layers, components, and architectural features of printhead 114 can be formed using various precision microfabrication and integrated circuit fabrication techniques such as electroforming, laser ablation, anisotropic etching, sputtering, spin coating, dry film lamination, dry etching, photolithography, casting, molding, stamping, machining, and the like.

Referring generally to FIGS. 2-4, printhead 114 is formed in part, of a layered architecture that includes a substrate 200 (e.g., glass, silicon) with a fluid slot 202, or trench, formed therein. Running along either side of the slot 202 are columns of fluid drop ejectors that generally comprise thermal resistors 210, fluid chambers 220, and nozzles 116. Formed over the substrate 200 is a thin-film layer 204, a primer layer 205, a chamber layer 206, and a nozzle layer 208 (also referred to as nozzle plate 208). The thin-film layer 204 implements thin film thermal resistors 210 and associated electrical circuitry such as drive circuits and addressing circuits (not shown) that operate to eject fluid drops from printhead 114. During processing of printhead 114, the removal (e.g., etching) of a portion of thin-film layer 204 creates an ink feed hole (IFH) 212 (shown as a dotted ellipse in FIG. 4) between the substrate 200 and the chamber layer 206. The IFH 212 allows fluid ink flow between the substrate and chamber layer by enabling an extension of the slot 202 into the chamber layer 206 from the substrate 200. Thus, the thin-film layer 204 can also be referred to as the ink feed hole layer 204. The dotted lines 400 with arrows in FIGS. 2 and 4 show the general direction of ink flow through the slot 202 from the substrate 200 and into the chambers 220 of chamber layer 206. The flow proceeds through the ink feedhole (IFH) 212 and to the left and right between particle tolerant pillars 222 and into fluid chambers 220.

In the example implementation shown in FIGS. 2-4, thermal resistors 210 are formed in the thin-film layer 204 and located in columnar arrays along either side of the fluid slot 202. The thin-film layer 204 comprises a number of different layers (not illustrated individually) that include, for example, an oxide layer, a metal (e.g., tantalum) layer that defines the thermal resistors 210 and conductive traces (not shown), and a passivation layer. A passivation layer can be formed of several materials, such as silicon oxide, silicon carbide, and silicon nitride. As shown in FIGS. 2 and 3, the thin-film layer 204 can extend across the IFH 212 from one side of the substrate 200 to the other. In this implementation, the thin-film layer extension forms part of an IFH bridge 216 that spans the gap in the fluid slot gap over the IFH 212.

The primer layer 205 formed over thin-film layer 204 is typically formed of a photo-definable epoxy such as SU8 epoxy, which is a polymeric material commonly used in the fabrication of microfluidic and MEMS devices. Primer layer 205 can also be made of other materials such as a polyimide, a deposited dielectric material, a plated metal, and so on. Like the thin-film layer 204, the primer layer 205 can extend across the IFH 212 from one side of the substrate 200 to the other, and form part of an IFH bridge 216 that spans the gap in the fluid slot gap over the IFH 212.

The chamber layer 206 formed over the thin-film layer 204 and primer layer 205, includes a number of fluidic features such as channel inlets that lead to the fluid/ink firing chambers 220. As shown in FIGS. 2 and 4, chamber walls 214 patterned into chamber layer 206 form the fluidic firing chambers 220 around corresponding thermal resistors 210 (ejection elements). In some implementations, the chamber layer 206 also includes particle tolerant architectures in the form of particle tolerant pillars 222. The pillars 222 are formed during the fabrication of chamber layer 206, and are located near the inlets to the chambers 220. The pillars 222 help prevent small particles in the ink from entering and/or blocking ink flow to chambers 220. Like primer layer 205, the chamber layer 206 is typically formed of SU8 epoxy, but can also be made of other materials such as a polyimide. Like the thin-film layer 204 and primer layer 205, the chamber layer 206 can extend across the IFH 212 from one side of the substrate 200 to the other. Thus, the chamber layer extension can form all or part of an IFH bridge 216 that spans the gap in the fluid slot gap over the IFH 212. The chamber layer extension that forms the IFH bridge 216 comprises extensions of chamber walls 214 across the IFH 212 between two corresponding chambers 220. In the example shown in FIGS. 2-4, because the chambers 220 on either side of the fluid slot 202 are staggered, the IFH bridges 216 across the IFH 212 are slanted to meet the corresponding chamber walls 214 of the staggered chambers 220.

Nozzle plate 208, is formed on the chamber layer 206 and includes nozzles 116 that each correspond with a respective chamber 220 and thermal resistor ejection element 210. The nozzle plate 208 forms a top over the fluid slot 202 and other fluidic features of the chamber layer 206 (e.g., the channel inlets, firing chambers 220, particle tolerant pillars 222, the IFH bridges 216). The nozzle plate 208 is typically formed of SU8 epoxy, but it can also be made of other materials such as a polyimide. In general, the chamber layer extension of the IFH bridge 216 abuts or is adjacent to the nozzle plate 208 (i.e., nozzle layer 208). Through this contact with the IFH bridge 216, the nozzle plate 208 is supported, and is bound to the substrate 200 through the IFH bridge 216 in a manner that restrains the nozzle plate 208 during the process of removing nozzle tape, reducing the occurrence of nozzle layer tear outs.

Figure 5:
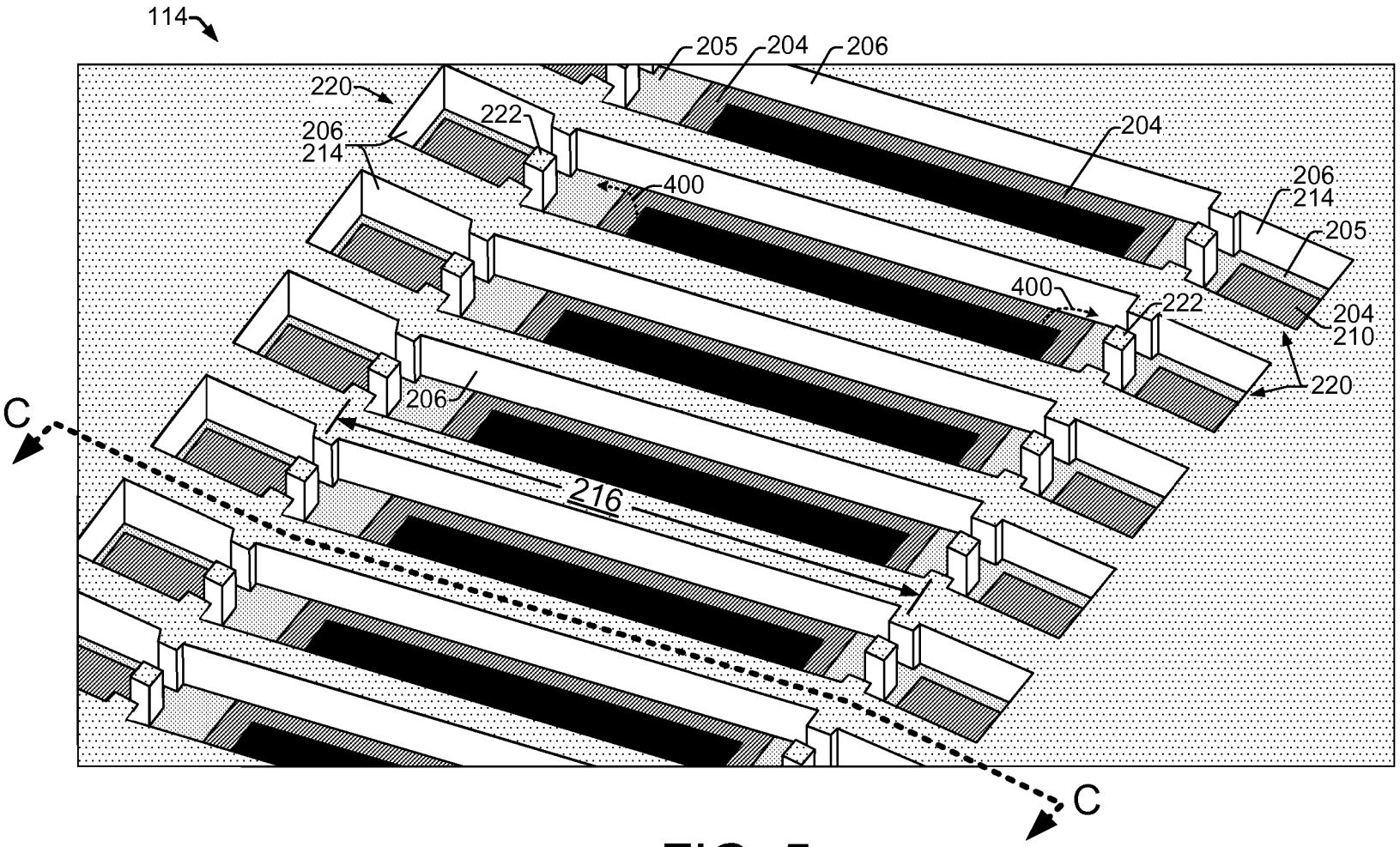
FIG. 5 shows a perspective view of a portion of a printhead with IFH bridges that include a thin-film layer extension and a chamber layer extension, but not a primer layer extension, according to an example implementation.
Figure 7:
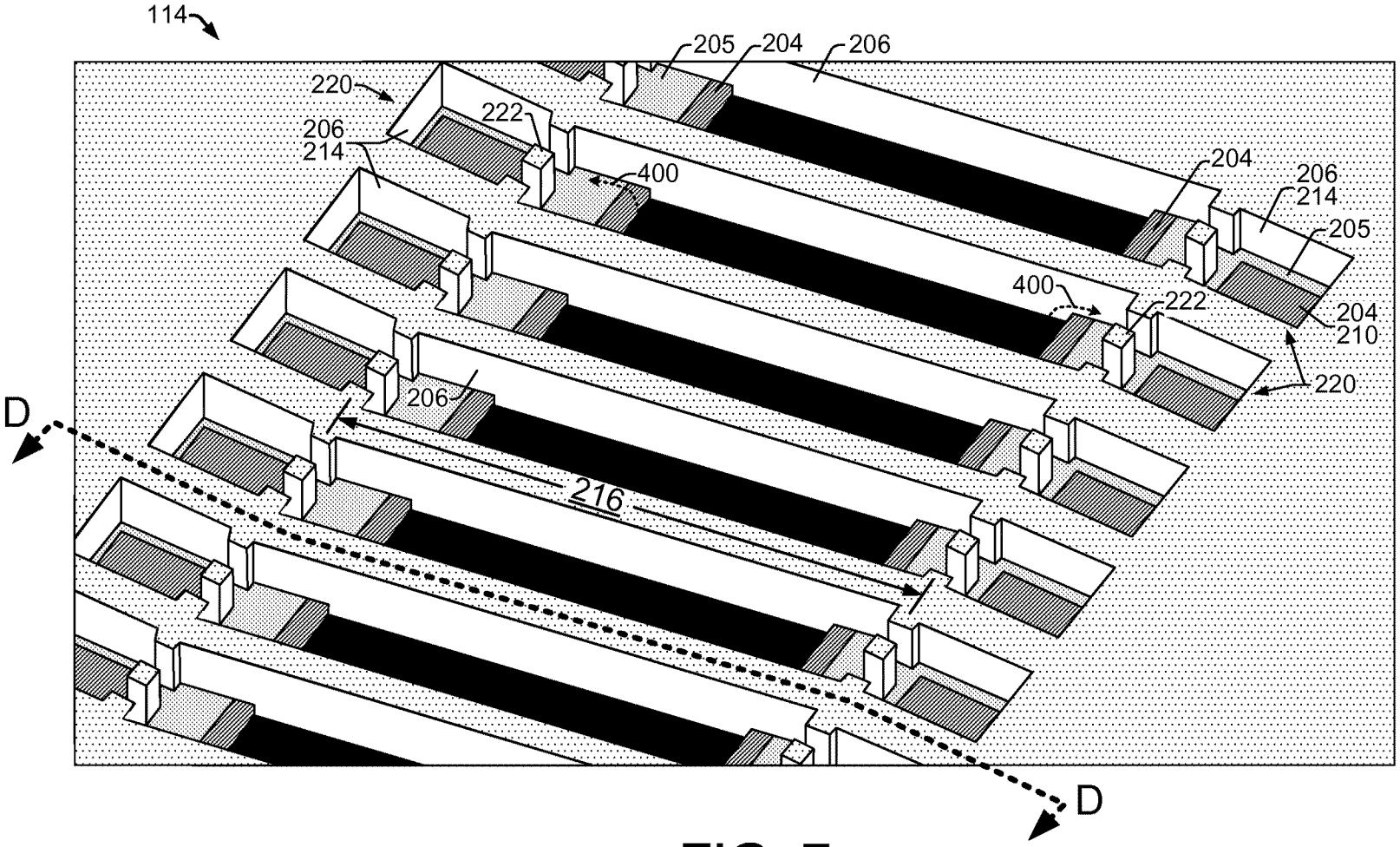
FIG. 7 shows a perspective view of a portion of a printhead with IFH bridges that include a chamber layer extension, but not a thin-film layer extension or a primer layer extension, according to an example implementation.
Figure 6:
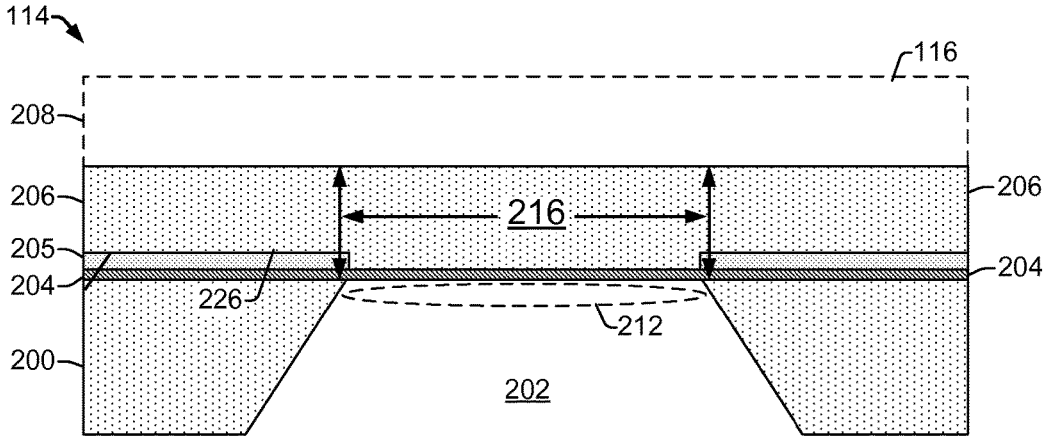
FIG. 6 shows a corresponding cross-sectional side view taken from the printhead of FIG. 5, according to an example implementation.
Figure 8:
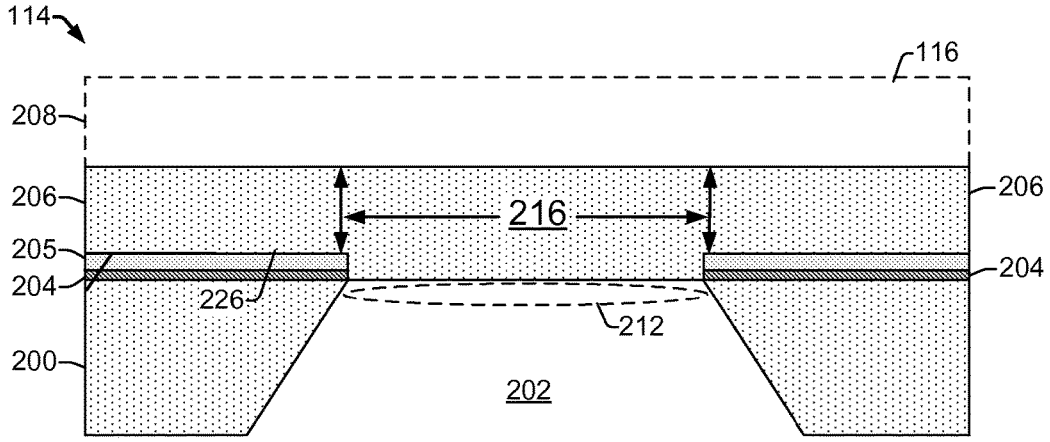
FIG. 8 shows a corresponding cross-sectional side view taken from the printhead of FIG. 7, according to an example implementation.

While the IFH bridges 216 are shown in FIGS. 2 and 3 as including all three of the thin-film layer extension 204, the primer layer extension 205, and the chamber layer extension 206, the IFH bridges 216 in different implementations can include fewer layer extensions. For example, FIG. 5 shows a perspective view of a portion of a printhead 114, where the IFH bridges 216 include the thin-film layer extension 204 and the chamber layer extension 206, but not the primer layer extension 205. FIG. 6 shows the corresponding cross-sectional side view (C-C) taken from the printhead 114 of FIG. 5 in which the IFH bridges 216 include the thin-film layer extension 204 and the chamber layer extension 206, but not the primer layer extension 205. In another example implementation, FIG. 7 shows a perspective view of a portion of a printhead 114, where the IFH bridges 216 include the chamber layer extension 206, but not the thin-film layer extension 204 or the primer layer extension 205. FIG. 8 shows the corresponding cross-sectional side view (D-D) taken from the printhead 114 of FIG. 7 in which the IFH bridges 216 include the chamber layer extension 206, but not the thin-film layer extension 204 or the primer layer extension 205. Note that because the SU8 chamber layer 206 is formed prior to the formation of the fluid slot 202, which removes substrate 200 material, the lower portion of chamber layer 206 within the IFH region 212 aligns to the top of substrate 200, even with the thin-film layer 204.

Figure 9:
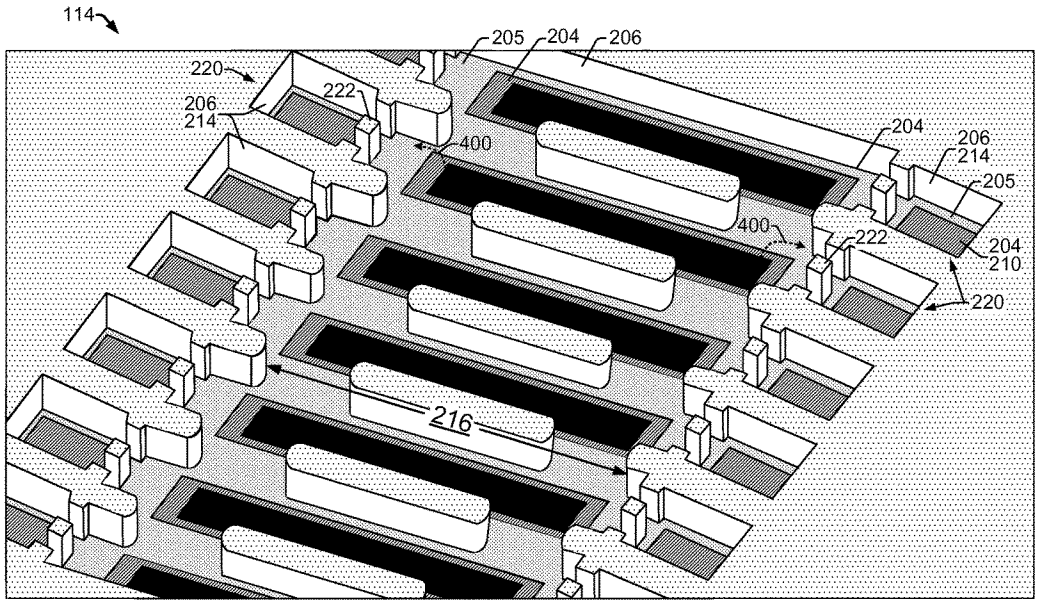
FIG. 9 shows a printhead with partial IFH bridges that include a thin-film layer extension extending fully across the IFH and a discontinuous segment of the chamber layer that extends partially across the IFH, according to an example implementation.

While a particular design of IFH bridges 216 has been illustrated and discussed herein, variations on both the design and the number, or density, of IFH bridges 216 within a printhead 214 are contemplated through this disclosure. For example, instead of an IFH bridge 216 spanning the IFH 212 between the walls 214 of each chamber 220, fewer IFH bridges 216 might be used to span the IFH 212. Thus, in different example implementations, IFH bridges 216 might span the IFH 212 between walls 214 of every other chamber 220, or every third chamber 220, and so on. In addition, the shape of the design of the IFH bridges 216 in some implementations can be different than that shown in FIGS. 2, 5, and 7. For example, instead of IFH bridges 216 that extend straight across the IFH 212, IFH bridges 216 in different implementations can extend across the IFH 212 in curved or wavy shapes or patterns. In addition, in other implementations, such as the example printhead 114 shown in FIG. 9, IFH bridges 216 may comprise partial IFH bridges 216 that include a thin-film layer extension 204 extending fully across the IFH 212 combined with a discontinuous segment of the chamber layer 206 that extends partially across the IFH 212.

What is claimed is:

1. A fluid ejection device comprising:

a substrate with a fluid slot formed therein;

a chamber layer formed on the substrate defining a plurality of pairs of fluid chambers, each pair of fluid chambers comprising a first fluid chamber on a first side of the fluid slot and a second fluid chamber on a second side of the fluid slot;

a thin-film layer between the substrate and chamber layer that defines an ink feedhole (IFH) between the fluid slot and the chamber layer; and a chamber layer extension comprising a number of discontinuous bridges across the IFH between each pair of fluid chambers, wherein the thin-film layer extends across an entirety of the IFH.

2. A fluid ejection device as in claim 1, further comprising:

a thin-film layer extension that forms part of each bridge across the IFH.

3. A fluid ejection device as in claim 2, further comprising:

a primer layer between the chamber layer and the thin-film layer; and a primer layer extension that forms part of each bridge across the IFH.

4. A fluid ejection device as in claim 1, further comprising a nozzle plate formed over the chamber layer and adjacent to the chamber layer extension over the IFH.

5. A fluid ejection device as in claim 1, wherein the chamber layer extension comprises an extension of chamber walls of the first fluid chamber and the second fluid chamber of each pair of fluid chambers.

6. The fluid ejection device of claim 1, wherein each fluid chamber of the chamber layer comprises chamber inlet, and wherein the chamber layer defines, for each fluid chamber, a pillar located near the chamber inlet.

7. The fluid ejection device of claim 1, wherein each fluid chamber of the chamber layer comprises a chamber inlet that is connected to the IFH.

8. A fluid ejection device comprising:

a thin-film layer on a substrate;

a chamber layer that defines a plurality of chambers;

a primer layer between the thin-film layer and the chamber layer;

thermal resistors formed in the thin-film layer and positioned proximate the chambers of the chamber layer;

a slot extending through the substrate and into the chamber layer through an ink feedhole (IFH) defined in the thin-film layer, wherein the plurality of chambers comprises a plurality of chamber pairs, each of the chamber pairs comprising a first chamber on a first side of the slot and a second chamber on a second side of the slot; and a plurality of IFH bridges comprising a discontinuous chamber layer extension across the IFH between each of the chamber pairs;

wherein the thin-film layer extends across an entirety of the IFH.

9. A fluid ejection device as in claim 8, further comprising a nozzle plate over the chamber layer and adjacent to the IFH bridge.

10. A fluid ejection device as in claim 8, the IFH bridge further comprising a primer layer extension across the IFH, the primer layer extension between the chamber layer extension and the thin-film layer extension.

11. A fluid ejection device as in claim 8, wherein the chamber layer extension comprises a continuation of chamber walls from the chambers.

12. A fluid ejection device comprising:

a substrate with a fluid slot formed therein:

a chamber layer formed on the substrate defining fluid chambers on both sides of the fluid slot;

a thin-film layer between the substrate and chamber layer that defines an ink feedhole (IFH) between the fluid slot and the chamber layer comprising a thin-film layer extension that extends across an entirety of the IFH;

a discontinuous chamber layer segment on the thin-film layer extension, the thin-film layer extension and discontinuous chamber layer segment forming an IFH bridge.

13. A fluid ejection device as in claim 12, further comprising:

a nozzle plate, wherein the IFH bridge is adjacent to the nozzle plate and provides a bond between the substrate and the nozzle plate through the IFH bridge.

14. The fluid ejection device of claim 12, further comprising:

thermal resistors formed in the thin-film layer; and a primer layer between the thin-film layer and the chamber layer.

15. The fluid ejection device of claim 14, comprising a primer layer extension that forms part of the IFH bridge.

16. The fluid ejection device of claim 12, wherein the discontinuous chamber layer segment extends partially across the IFH.

* * * * *